US006579834B2

(12) United States Patent
Maeda et al.

(10) Patent No.: US 6,579,834 B2
(45) Date of Patent: Jun. 17, 2003

(54) AQUEOUS RELEASE AGENTS FOR LOW SPEED INJECTION DIE CASTING

(75) Inventors: Yasuyuki Maeda, Fukui (JP); Dai Masuda, Fukui (JP)

(73) Assignee: Nicca Chemical Co., Ltd., Fukui (JP)

( * ) Notice: Subject to any disclaimer, the term of this patent is extended or adjusted under 35 U.S.C. 154(b) by 0 days.

(21) Appl. No.: 09/772,875

(22) Filed: Jan. 31, 2001

(65) Prior Publication Data

US 2001/0031707 A1 Oct. 18, 2001

(30) Foreign Application Priority Data

Mar. 17, 2000 (JP) ..... 2000-075788

(51) Int. Cl.[7] ..... C10M 173/02; B28B 7/38

(52) U.S. Cl. ..... 508/155; 508/161; 508/506; 508/591; 106/38.22; 106/38.3; 106/626; 106/628

(58) Field of Search ..... 508/155, 161, 508/506, 591; 106/38.3, 38.22, 626, 628

(56) References Cited

U.S. PATENT DOCUMENTS

| | | | | |
|---|---|---|---|---|
| 4,195,002 | A | * | 3/1980 | Radtke et al. |
| 4,454,050 | A | | 6/1984 | Bertell |
| 5,141,659 | A | * | 8/1992 | Kashiwaya et al. |
| 5,340,486 | A | * | 8/1994 | Willoughby |
| 5,409,531 | A | | 4/1995 | Deyama et al. |
| 5,776,866 | A | * | 7/1998 | Karaki et al. |
| 6,034,041 | A | * | 3/2000 | Nittel et al. |

FOREIGN PATENT DOCUMENTS

| | | |
|---|---|---|
| JP | 5-007978 | 1/1993 |
| JP | 5-156028 | 6/1993 |
| JP | 6-114494 | 4/1994 |
| JP | 9-066340 | 3/1997 |

* cited by examiner

*Primary Examiner*—Jerry D. Johnson
(74) *Attorney, Agent, or Firm*—Oblon, Spivak, McClelland, Maier & Neustadt, P.C.

(57) ABSTRACT

This invention provides a release agent for low speed casting, which does not pollute working environment, has a superior running property and lubricating property and further shows a superior cleanability of a die.

An aqueous release agent for a low speed injection die casting comprises as main components an inorganic lubricant, spherical resin particles having an average particle size of 0.1–10 $\mu$m, an organic carboxylic acid metal salt and water.

5 Claims, No Drawings

AQUEOUS RELEASE AGENTS FOR LOW SPEED INJECTION DIE CASTING

FIELD OF THE INVENTION

This invention relates to a release agent having excellent running and lubricating properties, which can be used for a low speed injection casting such as squeeze casting.

BACKGROUND OF THE INVENTION

A low speed injection casting process with a slow casting speed of a molten material may produce cast products with a high strength because it hardly entraps of the air or gas in a die. Therefore, the low speed injection casting has been adopted for manufacturing safety parts for automobile, which are progressively being made of aluminum from the standpoint of weight saving.

The low speed injection casting requires good lubricating property, because a molten material is easily cooled and solidified prior to reaching the end of a die owing to its low casting speed, and should be pushed by a plunger or a localized pressure pin for preventing shrinkage cavity.

The release agents hitherto used for low speed injection casting are graphite (JP-A 5-7978), a dispersion of white inorganic powders such as talc and mica or a combination of said dispersion of inorganic powders with a wax emulsion (JP-A 9-66340), and an aqueous suspension of granules of the release agent composed of a porous synthetic silicic acid compound having a specific surface area of 40 $m^2/g$ or more (JP-A 6-114494).

However, in regard to the prior art as mentioned above, graphite has the problem that it has a good lubricating property but may cause pollution of surrounding working environment because of its black color. On the other hand, the inorganic powder system may provide a favorable working environment, but it has the problem that the lubricating property may be insufficient and sediment may be easily formed over a die, which has difficulty in cleanability, so that it may take a prolonged time to polish a die, resulting in lowered productivity.

SUMMARY OF THE INVENTION

This invention is to solve the above-mentioned problems and an object of this invention is to provide a release agent for low speed casting which does not cause any pollution of working environment and shows superior running property and lubricating property with an excellent cleanability of a die.

The low speed injection casting (or die casting) as used herein includes squeeze casting, die casting with laminar flow charging, and vertical pressure casting, and refers to a casting process wherein a molten material is cast into a die at a low speed (0.05–2.00 m/s) and then solidified under elevated pressure (100–1500 $kg/cm^2$).

DETAILED EXPLANATION OF THE INVENTION

We have made our studies in order to achieve the above object and found out that the most excellent is an aqueous release agent which comprises an inorganic lubricant, spherical resin particles having an average particle size of 0.1–10 $\mu$m, an organic carboxylic acid metal salt and water, upon which this invention has been completed.

This invention is directed to an aqueous release agent for a low speed injection die casting, which comprises as main components an inorganic lubricant, spherical resin particles having an average particle size of 0.1–10 $\mu$m, an organic carboxylic acid metal salt and water.

The invention is also directed to the said release agent, which comprises 100 parts by weight of said inorganic lubricant, 5–100 parts by weight of said spherical resin particles having an average particle size of 0.1–10 $\mu$m, 5–100 parts by weight of said organic carboxylic acid metal salt and 100–1000 parts by weight of water.

The invention is further directed to the said release agent characterized in that said spherical particles are in the form of an aqueous dispersion of fine particles of a polyolefin.

The invention is further directed to the said release agent characterized in that said inorganic lubricant is at least one selected from the group consisting of talc, kaolin, mica and boron nitride.

The invention is further directed to the said release agent characterized in that said organic carboxylic acid metal salt is at least one selected from the group consisting of sodium adipate, sodium isophthalate and sodium tetrahydrophthalate.

Moreover, the invention is directed to the said release agent characterized in that said inorganic lubricant is a lubricant having a flake lamellar structure and an average particle size of 1–10 $\mu$m.

This invention will be illustrated in detail hereinafter. The release agent according to this invention comprises as the essential components the inorganic lubricant, spherical resin particles, organic carboxylic acid metal salt and water as explained below.

(1) Inorganic Lubricant

The inorganic lubricant includes powdery talc, kaolin, mica and boron nitride, which may be used alone or in combination of the two or more. In particular, preferable is the lubricant such as talc, which has an average particle size of 0.1–20 $\mu$m, preferably 1–10 $\mu$m and a flake lamellar structure. The lubricant of the said structure makes it possible for the release agent to form a film wherein spherical resin particles are incorporated between the layers of the inorganic powdery lubricant having a flake lamellar structure, and therefore exceptionally improves the lubricating property as compared with the inorganic lubricant itself.

(2) Spherical Resin Particles

The resin particles to be used may be a resin in the form of spherical fine particles having an average particle size of 0.1–10 $\mu$m, preferably 0.5–5 $\mu$m. Even in the case of fine particles having an average particle size of not more than 0.1 $\mu$m or non-spherical particles, the lubricating property of flake lubricant such as talc may be improved, but not so significantly. As such spherical resin particles, an aqueous dispersion of fine particles of a polyolefin may be preferably used. The aqueous dispersion is prepared, for example, according to the method described in JP-A 5-156028, which comprises preparing a polyolefin molten mixture composed of an olefinic polymer and an olefinic polymer containing an unsaturated carboxylic acid, and then dispersing the mixture in an alkaline water under stirring at a high speed. The aqueous dispersion of spherical polyolefin fine particles having an average particle size of 0.1–10 $\mu$m may also be commercially available as "CHEMIPEARL" (Trade name, manufactured by Mitsui Chemicals, Inc.).

(3) Organic Carboxylic Acid Metal Salt

Blending of the organic carboxylic acid metal salt may further improve the lubricating property and provide a coating film of the release agent with hydrophilic nature and an improved elimination of the release agent sedimented over a die.

The preferable organic carboxylic acid metal salt includes alkali metal salts such as sodium salts and potassium salts of adipic acid, sebacic acid, dodecanedicarboxylic acid, fumaric acid, phthalic acid, isophthalic acid, terephthalic acid, tetrahydrophthalic acid, trimellitic acid, pyromellitic acid, maleic acid, succinic acid and the like, and they may be used alone or in combination thereof. In particular, sodium adipate, sodium isophthalate and sodium tetrahydrophthalate are preferable in view of lubricating property.

(4) Water

Ordinary tap water may be used, but ion-exchanged water may be preferably used.

(5) Other Components

If necessary, hydroxymethyl cellulose, for example, may be blended in order to prevent sedimentation of the release agent or to accomplish thickening. In this case, it may be preferably used at approximately 10 parts by weight per 100 parts by weight of the inorganic lubricant.

(6) Amounts of the Components to be Blended and Preparation of Materials for Release Agent The materials for the present release agent comprise the powdery inorganic lubricant, spherical resin particles, organic carboxylic acid metal salt and water as main components. The amounts of the components to be blended are 100 parts by weight of the inorganic lubricant, 5–100 parts by weight, preferably 10–50 parts by weight of the spherical resin particles, 5–100 parts by weight, preferably 10–50 parts by weight of the organic carboxylic acid metal salt and 100–1000 parts by weight of water.

The materials are to be processed using a high-speed stirrer and the like.

(7) When the Release Agent of this Invention is to be Applied, It may be 5–50-Fold Diluted with Water and then Spray-Coated, for Example, to Form a Uniform Film of the Release Agent on the Die Surface.

This invention will be illustrated in greater detail on the basis of the following examples, but this invention is not to be limited thereto.

Raw Materials (1) Inorganic Lubricant

Talc: LMS-200 (Tsuchiya Kaolin, average particle size of 1.5–1.8 μm)

(2) Resin Particles

Spherical polyolefin 1: "CHEMIPEARL W-300 (Trade name)" manufactured by Mitsui Chemicals, Inc. (Low molecular weight polyolefin, solid content of 40%, particle size of 3 μm).

Spherical polyolefin 2: "CHEMIPEARL M-200 (Trade name)" manufactured by Mitsui Chemicals, Inc. (Low density polyolefin, solid content of 40%, particle size of 6 μm).

Spherical polyolefin 3: "CHEMIPEARL v-300 (Trade name)" manufactured by Mitsui Chemicals, Inc. (Vinyl acetate copolymerized polyolefin, solid content of 40%, particle size of 6 μm).

Spherical polyolefin 4: "CHEMIPEARL A-100 (Trade name)" manufactured by Mitsui Chemicals, Inc. (Thermoplastic elastomer, solid content of 40%, particle size of 4 μm).

Spherical polyolefin 5: "CHEMIPEARL S-300 (Trade name)" manufactured by Mitsui Chemicals, Inc. (Ionomer, solid content of 35%, particle size of 0.5 μm).

Each of the above resins was added so as to give a solid content of 5 parts. The particle size was a numerical value as measured by means of Coulter counter.

Polyethylene wax: "629" (manufactured by Allied Signal Inc.) was formed to an emulsion with a wax content of 20% using an addition product of a higher alcohol of 12 carbon atoms to 9 moles of ethylene oxide (particle size of 0.1 μm). It was incorporated in such an amount that a wax content should be 5 parts.

(3) Organic Carboxylic Acid Metal Salt

Sodium adipate, sodium isophthalate and sodium tetrahydrophthalate were used.

(4) Other Components

An addition product of a higher alcohol of 12 carbon atoms to 9 moles of ethylene oxide was used as a surfactant.

Hydroxyethyl cellulose ("HEC DAICEL SP-200" (Trade name), manufactured by Daicel Chemical Industries, Ltd.) was used as an anti-settling agent.

Evaluation Method (1) Lubricating Property

The lubricating property of films of the release agent was tested according to the ring compression method used for evaluation of lubricating agents for plastic processing, and evaluated with the friction coefficient thus obtained. The die had a dimension of a diameter 100 mm×a thickness 10 mm and a material of SKD61. Two dies were used for the test. The die was heated to about 200° C. and 10 ml of the sample 30-fold diluted with water was spray-coated onto one side of the die to form a uniform film. The aluminum ring test piece (material of A5052, outer diameter 54 mm×inner diameter 27 mm×height 18 mm) preheated to about 500° C. was interposed between the film surfaces of the two dies and then compressed at a compression rate of 50% by a 100-ton oil press. The friction coefficient was calculated from the compression rate and change rate in inner diameter of the test piece after compressed.

(2) Die Cleanability

The dies used for the above lubricating property test (1) were softly rubbed with a gauge dipped in water, and evaluated based on the amount of eliminating of the film of the release agent over the die.

A: Little release agent film remained

B: Release agent film slightly remained

C: Release agent film considerably remained

EXAMPLE 1

The surfactant was dissolved in water and the talc was added with high speed stirring. When a uniform mixture was obtained, the disodium adipate, the spherical polyolefin and the hydroxyethyl cellulose were added and admixed to prepare a release agent.

The evaluation results are shown in Table 1.

| Composition of release agent | |
|---|---|
| Water | 73 parts |
| Surfactant: | |
| Addition product of a higher alcohol of 12 carbon atoms to 9 moles of ethylene oxide | 1 part |
| Talc: | |
| LMS-200 (Tsuchiya Kaolin) | 15 parts |
| Disodium adipate | 5 parts |
| Spherical polyolefin: | 5 parts |
| CHEMIPEARL W-300 (Mitsui Chemicals) | (as a solid) |
| Hydroxyethyl cellulose | 1 part |
| Total | 100 parts |

EXAMPLES 2–7 AND COMPARATIVE EXAMPLES 1–5

The release agents were prepared and evaluated under the same conditions as described in Example 1 except for their blending and composition. The results are shown in Table 1 and 2.

TABLE 1

| | Ex. 1 | Ex. 2 | Ex. 3 | Comp. Ex. 1 | Comp. Ex. 2 | Comp. Ex. 3 | Comp. Ex. 4 | Comp. Ex. 5 |
|---|---|---|---|---|---|---|---|---|
| Talc | 15 | 15 | 15 | 15 | 15 | 15 | 15 | 15 |
| Spherical polyolefin 1 | 5 | 5 | 5 | | 5 | | | |
| Polyethylene wax | | | | | | 5 | | |
| Sodium adipate | 5 | | | | | | 5 | |
| Sodium isophthalate | | 5 | | | | | | |
| Sodium tetrahydrophthalate | | | 5 | | | | | 5 |
| Surfactant | 1 | 1 | 1 | 1 | 1 | 1 | 1 | 1 |
| Hydroxyethyl cellulose | 1 | 1 | 1 | 1 | 1 | 1 | 1 | 1 |
| Water | q.s. | q.s. | q.s. | q.s. | q.s. | q.s. | q.s. | q.s. |
| Total (part by weight) | 100 | 100 | 100 | 100 | 100 | 100 | 100 | 100 |
| Lubricating property ($\mu$) | 0.05 | 0.06 | 0.05 | 0.3< | 0.10 | 0.17 | 0.18 | 0.18 |
| Die cleanability | A | A | A | B | C | C | A | A |

TABLE 2

| | Ex. 4 | Ex. 5 | Ex. 6 | Ex. 7 |
|---|---|---|---|---|
| Talc | 15 | 15 | 15 | 15 |
| Spherical polyolefin 2 | 5 | | | |
| Spherical polyolefin 3 | | 5 | | |
| Spherical polyolefin 4 | | | 5 | |
| Spherical polyolefin 5 | | | | 5 |
| Sodium adipate | 5 | 5 | 5 | 5 |
| Surfactant | 1 | 1 | 1 | 1 |
| Hydroxyethyl cellulose | 1 | 1 | 1 | 1 |
| Water | q.s. | q.s. | q.s. | q.s. |
| Total | 100 | 100 | 100 | 100 |
| Lubricating property ($\mu$) | 0.05 | 0.05 | 0.05 | 0.09 |
| Die cleanability | A | A | A | A |

INDUSTRIAL APPLICABILITY

The release agent of this invention shows a good running property because of an excellent heat retaining property and belated cooling speed of a molten material. Further because of its superior lubricating property, it provides not only an improved releasing property and smoothness of casting surface, but also remarkably reduces shrinkage cavity or air entrapping cavity by the final pressure of a plunger or a pressure pin being extended up to the end of a product. Those superior properties improve the product quality and make welding possible by heat treatment.

The cleanability is also superior because dry solids may be easily redispersed in water. A time for polishing a die may be greatly shortened.

Moreover, there is no possibility of polluting working environment.

What is claimed is:

1. An aqueous release agent for a low speed injection die casting which comprises as main components an inorganic lubricant having a flake lamellar structure of an average particle size of 1–10 $\mu$m and being selected from the group consisting of talc, kaolin, mica and boron nitride, spherical polyolefin resin particles having an average particle size of 0.1–10 $\mu$m, an organic carboxylic acid metal salt, and water, wherein a weight ratio of the inorganic lubricant to the spherical polyolefin resin particles is from 1:1 to 20:1.

2. The aqueous release agent as claimed in claim 1, which comprises 100 parts by weight of the inorganic lubricant, 5–100 parts by weight of the spherical polyolefin resin particles, 5–100 parts by weight of the organic carboxylic acid metal salt, and 100–1000 parts by weight of water.

3. The aqueous release agent as claimed in claim 1, wherein the spherical polyolefin resin particles are in the form of an aqueous dispersion.

4. The aqueous release agent as claimed in claim 1, wherein the organic carboxylic acid metal salt is at least one selected from the group consisting of sodium adipate, sodium isophthalate and sodium tetrahydrophthalate.

5. A method of making a release agent, the method comprising combining an inorganic lubricant, spherical polyolefin resin particles, an organic carboxylic acid metal salt, and water; and forming the aqueous release agent of claim 1.

* * * * *